US005131961A

United States Patent [19]

Sato et al.

[11] Patent Number: 5,131,961

[45] Date of Patent: Jul. 21, 1992

[54] METHOD FOR PRODUCING A NICKEL-BASE SUPERALLOY

[75] Inventors: Koji Sato; Rikizo Watanabe, both of Yasugi, Japan

[73] Assignee: Hitachi Metals, Ltd., Tokyo, Japan

[21] Appl. No.: 413,173

[22] Filed: Sep. 27, 1989

[30] Foreign Application Priority Data

Sep. 30, 1988 [JP] Japan ..... 63-247162

[51] Int. Cl.[5] ..... C22F 1/10

[52] U.S. Cl. ..... 148/677; 420/448; 148/410; 148/428; 148/556

[58] Field of Search ..... 420/448; 148/410, 428, 148/12.7 N

[56] References Cited

U.S. PATENT DOCUMENTS 4,039,330 8/1977 Shaw ..... 420/448
4,769,087 9/1988 Genereux et al. ..... 142/2

FOREIGN PATENT DOCUMENTS 0184136 6/1986 European Pat. Off. .
0235075 9/1987 European Pat. Off. .
0260510 3/1988 European Pat. Off. .
1418583 11/1965 France .
2223470 10/1974 France .
2430985 2/1980 France .
46-022333 6/1971 Japan .
63-114933 5/1988 Japan .
63-145737 6/1988 Japan .
1580534 12/1980 United Kingdom .

*Primary Examiner*—R. Dean
*Assistant Examiner*—Margery S. Phipps
*Attorney, Agent, or Firm*—Antonelli, Terry Stout & Kraus

[57] ABSTRACT

A method of forming a Ni-base superalloy suitable for use as the material for gas turbine disks or the like has a composition containing, by weight, 0.01 to 0.15% of C, 15 to 22% of Cr, 3 to 6% of Mo, 3 to 6% of W, 5 to 15% of Co, 1.0 to 1.9% of Al, 1.5 to 3.0% of Ti, 3.0 to 6.0% of Ta, 0.001 to 0.020% of B and the balance substantially Ni except inevitable impurities. This alloy is produced using the conventional ingot making and a hot working process including working at a reducing ratio greater than or equal to 10%, first above the $\gamma$ solvus temperature, and then during cooling to the recrystallization temperature and then subjected to direct aging without solid-solution treatment. As a result, the alloy exhibits excellent strength properties well comparable to those of expensive alloys produced by powder metallurgy process.

4 Claims, 1 Drawing Sheet

METHOD FOR PRODUCING A NICKEL-BASE SUPERALLOY

BACKGROUND OF THE INVENTION

1. Field of the Invention

The present invention relates to an Ni-base superalloy (i.e., super heat resisting alloy) which is suitable for use as the material for disks or the like of a gas turbine, which can be hot worked and which has a high strength comparable to that of powder metallurgy alloy, and to a method for producing the same.

2. Description of the Prior Art

Current trends for greater output and higher efficiency of gas turbines naturally require that heat resisting parts of gas turbines operate under severer conditions. In case of disks of gas sturbines, an increasing demand exists for improvement in the mechanical strength of the material for disks rather than for a rise in the maximum withstandable temperature of the disks. Thus, the following two kinds of approaches have been made to increase the performance of turbine disk material.

(1) Development of novel alloy having high $\gamma'$ phase content by powder metallurgy process.

(2) Improvement in the strength of existing ingot alloy by thermomechanical treatment.

As an example of Ni-base superalloy according to the approach (1), such a high strength alloy having $\gamma'$ phase content of about 50 vol.% as known under the name of RENE' 95 (RENE' being a trademark) or IN 100 (IN being a trademark) has been put to practical use in commercial base.

The RENE' 95 is an alloy which is disclosed in Japanese Patent Examined Publication No. 46-22333. Initially, it was attempted to fabricate this alloy by the conventional ingot making and subsequent hot working process. This attempt, however, was unsuccessful because of difficulty in fabricating this alloy from the ingot material due to containing a large amount of $\gamma'$ phase, so that this alloy is fabricated only by powder metallurgy process at present. On the other hand, the IN 100 has been developed as a cast alloy from the beginning, so that no attempt has been made to commercially fabricate this alloy by the ingot making and hot working process.

Further, Japanese Patent Unexamined Publication No. 63-114933 discloses an alloy which exhibits superior properties as a material for gas turbine disks. This alloy, however, also is a high $\Gamma'$ alloy containing about 45% of $\gamma'$ phase and, therefore, cannot be fabricated by the conventional ingot making and hot working process.

Thus. an alloy having high $\gamma'$ phase content becomes impossible to be hot worked and, hence, is obliged to adopt powder metallurgy process. The powder metallurgy process, however, employs a number of steps so that the price is raised uneconomically. In addition, the powder metallurgy process tends to allow the product to contain oxides, impairing the reliability of the product.

According to the approach (2) mentioned above, thermomechanical treatment, which is a combination of a hot working and a heat treatment, is effected on an Ni-base superalloy such as WASPALLOY (WASPALLOY being a trademark) or INCONEL 718 (INCONEL being a trademark), in order to achieve desired performance. Alloys obtained by such thermomechanical treatment exhibit mechanical properties which are excellent in comparison with conventional ingot alloys but are still inferior in comparison with those exhibited by supperalloys produced by the powder metallurgy process of the aforesaid approach (1).

Further, Japanese Patent Unexamined Publication No. 63-145737 discloses an alloy which is said to be a high-strength ingot alloy having $\gamma'$ phase content of 45 vol.% and exhibiting superior hot workability. However, it is very difficult to hot work this alloy and an extremely high degree of forging technique is required due to the $\gamma'$ phase content which is much higher than that of existing ingot alloy.

Considering merits and demerits of the aforementioned approaches (1) and (2) for increasing the performance of disk material, it is highly desirable to develop an alloy which can be produced by a process making use of existing production equipment, e.g., a process having the steps of conventional ingot making and hot working, and which has properties well comparable to those of alloys produced by powder metallurgy process, because such an alloy will enable inexpensive production of large-sized parts having high reliability.

SUMMARY OF THE INVENTION

Accordingly, an object of the present invention is to provide a high strength Ni-base superalloy which exhibits, despite a reduced $\gamma'$ phase content, a high strength well comparable to those of alloys produced by powder metallurgy process and which has excellent hot workability to enable easy production by conventional ingot making and hot working process.

Another object of the present invention is to provide a method for producing such a high strength Ni-base superalloy.

The present inventors have conducted an intensive study on alloy compositions suitable for use as materials of gas turbine disks, as well as on production methods, and found that an Ni base superalloy having high strength well comparable to those of powder metallurgy alloys and excellent hot workability can be obtained with a specific alloy composition even though the $\gamma'$ phase content is reduced to less than 40 vol.%.

Namely, the present invention provides a hot workable Ni-base superalloy which can be produced by ingot making process and which is characterized by having excellent properties, in particular high strength, well comparable to those of alloys which, in an alloy system of this field, hitherto could not be obtained by ingot making and hot working process and, therefore, were produced by powder metallurgy process.

According to a first aspect of the present invention, there is provided an Ni-base superalloy containing, by weight, 0.01 to 0.15% of C, 15 to 22% of Cr, 3 to 6% of Mo, 3 to 6% of W, 5 to 15% of Co, 1.0 to 1.9% of Al, 1.5 to 3.0% of Ti, 3.0 to 6.0% of Ta, 0.001 to 0.020% of B and the balance substantially Ni except inevitable impurities.

According to a second aspect of the present invention, there is provided an Ni-base superalloy containing, by weight, 0.01 to 0.05% of C, 17 to 19% of Cr, 4 to 5% of Mo, 4 to 5% of W, 8 to 12% of Co, 1.1 to 1.6% of Al, 2.1 to 2.7% of Ti, 4.2 to 5.0% of Ta, 0.005 to 0.015% of B and the balance substantially Ni except inevitable impurities.

According to a third aspect of the present invention, there is provided an Ni-base superalloy containing, by weight, 0.01 to 0.15% of C, 15 to 22% of Cr, 3 to 6% of Mo, 3 to 6% of W, 5 to 15% of Co, 1.0 to 1.9% of Al, 1.5 to 3.0% of Ti, Ta and Nb in an amount which meets the conditions of $3.0\% \leqq Ta+2Nb \leqq 6.0\%$ and $Ta \geqq 2Nb$, 0.001 to 0.020% of B and the balance substantially Ni except inevitable impurities.

According to a fourth aspect of the present invention, there is provided an Ni-base superalloy according to any one of the aforesaid first to third aspects, characterized in that the $\gamma'$ phase having a composition expressed by $Ni_3(Al_xTi_yTa_z)$ $(x+y+z=1)$ or $Ni_3(Al_xTi_yTa_zNb_w)$ $(x+y+z+w=1)$ is contained in an amount not greater than 40 vol.%, that the 0.2% offset yield strength at 650° C. is higher than 120 kgf/mm$^2$, and that the creep rupture time at 650° C. and 100 kgf/mm$^2$ is longer than 80 hours.

According to a fifth aspect of the present invention, there is provided a method for producing an Ni-base superalloy comprising the steps of: preparing an alloy according to any one of the aforesaid first to fourth aspects; subjecting said alloy to a final hot working in which said alloy is heated to and held at a temperature which is 20 to 100° C. higher than the $\gamma'$ phase's solvus temperature and then hot worked at reduction ratio of 10% or greater during cooling to the recrystallization temperature and subsequently at reduction ratio of 10% or greater at temperatures lower than the recrystallization temperature; and directly aging said hot worked alloy at a temperature lower than 850° C. without subjecting it to solid-solution heat treatment.

According to the present invention, the contents of the respective alloying components are limited for the following reasons.

In the present invention, C serves as a deoxidizer and, in addition, forms MC type carbides in combination with Ti, Ta and Nb. Further, when an aging without solid-solution heat treatment (hereafter, this aging is referred to "direct aging") is conducted, C discontinuously precipitates in grain boundaries $M_{23}C_6$ type carbides composed mainly of Cr, thereby strengthening the grain boundaries and thus improving creep rupture properties. In order to obtain these effects, the C content should be 0.01% at the smallest. On the other hand, any excessive C content exceeding 0.15% increases formation of primary carbides, thereby deteriorating the toughness. For these reasons, the C content should be limited to a range between 0.01 and 0.15%, preferably between 0.01 and 0.05%.

Cr is an element indispensable for obtaining oxidation resistance and corrosion resistance at high temperatures, and in order to meet oxidation resistance and corrosion resistance necessary for gas turbine disks, etc. the Cr content should be 15% at the smallest. On the other hand, if the Cr content exceeds 22% the structure becomes unstable and it becomes liable to form $\sigma$ phase, which is an brittle phase, in combination with Mo and W. For these reasons, the Cr content is limited to a range between 15 and 22%, preferably between 17 and 19%.

Mo is an element which dissolves into austenite phase so as to strengthen the matrix, thereby improving the strength at high temperatures. In order to obtain this effect, the Mo content should be 3% at the smallest. On the other hand, an excessive Mo content impairs the hot workability and, in addition, makes the structure unstable as Cr does, so that the upper limit of the Mo content is limited to 6%. Preferably, the Mo content is limited to a range between 4 and 5%.

W is an element which dissolves into the matrix to thereby improve the tensile strength as Mo does. However, W exhibits a smaller diffusion rate than Mo because W has an atomic weight which is about two times that of Mo, so that W makes a greater contribution to the reduction in the creep rate than Mo, thereby improving the creep rupture life. In order to obtain the above effect, the W content should be 3% at the smallest. On the other hand, addition of W in excess of 6% adversely affects hot workability and stability of the structure as Mo does and undesirably increases the specific weight of the alloy. For these reasons, the W content is limited to a range between 3 and 6%, preferably between 4 and 5%.

Co increases the amount of $\gamma'$ phase putting into solid solution at high temperature range so as to improve the hot workability. In order to obtain this effect, the Co content should be 5% at the smallest. However, an excessive Co content tends to cause precipitation of detrimental phases such as Laves phase or the like, so that the upper limit is limited to 15%. Preferably, the Co content is limit to a range between 8 and 12%.

Al is an indispensable element which allows precipitation of stable $\gamma'$ phase in combination with Ni, thereby obtaining the desired high temperature strength. In order to obtain this effect, the Al content should be 1.0% at the smallest. In the alloy of the present invention, in order to improve the high temperature strength, it is necessary that the lattice strain owing to precipitation of $\gamma'$ phase be increased by increasing the ratio $\{Ti+Ta(+Nb)\}Al$ in the $\gamma'$ phase to thereby increase the lattice constant of the $\gamma'$ phase. To this end, the upper limit of the Al content is limited to 1.9%. Preferably, the Al content is limited to a range between 1.1 and 1.6%.

Ti is an element which, like Al, allows precipitation of $\gamma'$ phase in combination with Ni, thereby increasing the high temperature strength. In order to obtain this effect, the Ti content should be 1.5% at the smallest. On the other hand, addition of Ti in excess of 3.0% inconveniently reduces the solid soluvility of Ta, which is an important element in the alloy of the present invention, into the $\gamma'$ phase, and undesirably allows precipitation of $\eta$ phase ($Ni_3Ti$) content is limited to a range between 1.5 and 3.0%, preferably between 2.1 and 2.7%.

One of the novel features of the alloy of the present invention over conventional alloys is based upon discovery of superior effect of Ta on creep rupture properties. In general, maximum operation temperature of disks of current gas turbines is around 650° C., and Ta acts very effectively in such temperature range. Like Ti mentioned above, Ta dissolves into Al side of $Ni_3Al$, thereby increasing the lattice constant of $\gamma'$ phase and thus improving the tensile strength. Further, with respect to agglomerating rate of the $\gamma'$ phase, Ta has an effect of retarding grain growth of the $\gamma'$ phase at a temperature range of about 650° C. because it has a larger atomic weight than another elements constituting the $\gamma'$ phase, so that it is effective for remarkably prolonging the creep rupture life. Ta belongs to the same group of the periodic table as Nb and has been considered to provide almost an equivalent effect on improvement of mechanical properites of Ni-base superalloy. The present inventors have found, however, that Ta produces, due to the fact that the atomic weight of Ta is two times that of Nb, a more advantageous effect on the agglomerating rate of $\gamma'$ phase than Nb and, hence, a greater effect in improving creep rupture strength.

The present invention makes an effective use of this newly found advantage of Ta.

In order to obtain the above effect, the Ta content should be 3.0% at the smallest. On the other hand, addition of Ta in excess of 6.0% adversely affects the hot workability and undesirably degrades ductility due to precipitation of the δ phase ($Ni_3Ta$). For these reasons, the Ta content is limited to a range between 3.0 and 6.0%, preferably between 4.2 and 5.0%.

Nb is an element belonging to the same group as Ta and produces a similar effect on improvement in the high temperature strength. The effect of Nb on improvement in the creep rupture life is not so remarkable as Ta. However, since Nb can be substituted with Ta at an atomic ratio up to 1:1 without causing substantial degradation in the properties, the Nb content is limited to a range which meets the conditions of $3.0 \leqq Ta + 2Nb \leqq 6.0$ and $Ta \geqq 2Nb$.

B is effective, owing to its effect for strengthening the grain boundaries, in improving both high temperature strength and ductility. In order to obtain this effect, the B content should be 0.001% at the smallest. However, the B content exceeding 0.020% causes the initial melting temperature of the alloy of the present invention to be lowered, thereby deteriorating the hot workability. For these reasons, the B content is limited to a range between 0.001 and 0.020%, preferably between 0.005 and 0.015%.

Further, in many of Ni-base supperalloys, Zr is considered to be an element which, like B, strengthens the grain boundaries but Zr is fundamentally different from B in that it is a primary carbide former. The important feature in the alloy of the present invention resides in the fact that the grain boundaries are strengthened by precipitation of suitable amount of $M_{23}C_6$ type carbides, so that in the alloy of the present invention no Zr is added, because if Zr were added the precipitation of the $M_{23}C_6$ type carbides at the grain boundaries would be decreased.

Ni is a basic element which constitutes an austenite matrix and a γ' precipitation strengthening phase which is $Ni_3$(Al, Ti, Ta) or $Ni_3$(Al, Ti, Ta, Nb).

Although inclusion of impurities such as Fe, Si, Mn, P, S, Mg, Ca, Zr and so forth is inevitable in the alloy of the present invention, such impurity elements may be contained if the contents of these elements meet the following conditions, because inclusion of such small amounts of impurity elements does not adversely affect the properties of the alloy.

$Fe \leqq 3.0\%$
$Si \leqq 0.5\%$
$Mn \leqq 1.0\%$
$P \leqq 0.03\%$
$S \leqq 0.03\%$
$Mg \leqq 0.02\%$
$Ca \leqq 0.02\%$
$Zr \leqq 0.01\%$ In addition to the limitations on the content ranges of the respective elemens described above, in the alloy of the present invention the upper limit for the content of the γ' phase composed of Ni in combination with Al, Ti and Ta or Ni in combination with Al, Ti, Ta and Nb is limited to 40 vol.%, in order to provide the alloys with an excellent hot workability when it is produced by the conventional ingot making and hot working process. It is possible to limit the γ' phase content to less than 40 vol.% by controlling the amounts of the γ' phase formers.

Further, the alloy of the present invention can exhibit excellent properties applicable to the material for gas turbine disk, etc. by the production method mentioned below. Namely, the alloy of the present invention has recrystallization temperature in a range of 1020°-1050° C. and thus exhibits excellent hot workability at temperatures higher than this recrystallization temperature. However, since the γ' phase s solvus temperature (i.e., the temperature at which the γ' phase completely dissolves into the matrix) of the alloy of the present invention is in a temperature range of 1075°-1120° C., when the alloy is hot worked at a temperature higher than the recrystallization temperature but lower than the γ' phase's solvus temperature it exhibits an excellent hot workability, but in this case nonuniform precipitation of the γ' phase remains, so that it is undesirable from the viewpoints of structure and mechanical properties. Further, when the alloy is heated at a temperature higher than the γ' phase's solvus temperature the nonuniformly precipitated γ' phase is completely dissolved into the matrix and, as a result, the crystal grains become easy to grow, but in this case it exhibits a more excellent hot workability than when it is hot worked at a temperature higher than the recrystallization temperature but lower than the γ' phase's solvus temperature and its microstructure after the hot working becomes uniform. For these reasons, at several heats in the initial stage of the hot working the alloy is plastically worked at a heating temperature higher than the γ' phase's solvus temperature, at which it exhibits an extremely excellent hot workability, into a form approximating the desired shape in some extent and then, at an intermediate stage of the hot working, it is hot worked after having been heated for the purpose of grain refinement at a temperature range higher than the recrystallization temperature but lower than the γ' phase's solvus temperature. Subsequently, it is heated for a short period of time in advance of the final hot working at a temperature which is 20° to 100° C. higher than the γ' phase's solvus temperature so as to dissolve the nonuniformly precipitated γ' phase into the matrix to thereby suppress as much as possible the growth of the crystal grains, and then it is finally hot worked.

More specifically, the alloy material to be worked, which has been heated to a temperature which is 20 to 100° C. higher than the γ' phase's solvus temperature prior to the final hot working, is worked at a reduction ratio of 10% or greater in the course of cooling to the recrystallization temperature, and subsequently worked at a reduction ratio of 10% or greater at a temperature lower than the recrystallization temperature so as to refine the crystal grains and impart a sufficient work strain. Incidentally, the term "reduction ratio" is used in this specification to mean the degree of the working effected on the alloy material. When the working is effected to reduce the cross-sectional area while increasing the length of the alloy material, the reduction ratio is expressed as follows:

$$\{(A-a)/A\} \times 100\%$$

where A and a respectively represent the cross-sectional area before and after the working. On the other hand, when the working is effected to reduce the length of the alloy material while increasing the cross-sectional area, i.e., an upset forging, the reduction ratio is expressed as follows:

$\{(L-l/L\} \times 100\%$ where L represents the original length of the material while l represents the length after the working.

When the heating temperature exceeds the temperature range which is 20° to 100° C. higher than the $\gamma'$ phase's solvus temperature the coarsening of the crystal grains is promoted and, on the other hand, when it is too low the $\gamma'$ phase is not completely dissolved into the matrix. In contrast to this, when the reduction ratio of the working effected during cooling to the recrystallization temperature is less than 10% it is impossible to satisfactorily refine the crystal grains and, on the other hand, when the reduction ratio of the working effected at temperatures lower than the recrystallization temperature is less than 10% the work strain becomes insufficient, so that it becomes impossible to obtain the desired strength. For these reasons, the reduction ratio is limited to 10% or greater.

Further, with respect to the heat treatment, a direct aging is effected without solid-solution heat treatment, in order to make use of the strengthening effect obtained in the crystal grains and grain boundaries owing to the work strain derived from the hot working. Since the aging has to be conducted at a temperature range in which the effect of the work strain is not extinguished, the upper limit temperature for the aging is limited to 850° C. One of the purposes of the aging is to cause a sufficient precipitation of fine $\gamma'$ phase in the grains, while another purpose is to precipitate $M_{23}C_6$ type carbides at the grain boundaries. In the case of direct aging the $M_{23}C_6$ type carbides are more easily precipitated at the grain boundaries in comparison with aging conducted after a solid-solution heat treatment and, in addition, they are precipitated in discontinuous and granular form, thereby strengthening the grain boundaries and greatly contributing to the improvement in the creep rupture life.

DESCRIPTION OF THE PREFERRED EMBODIMENTS

EXAMPLE 1

Figure 2:
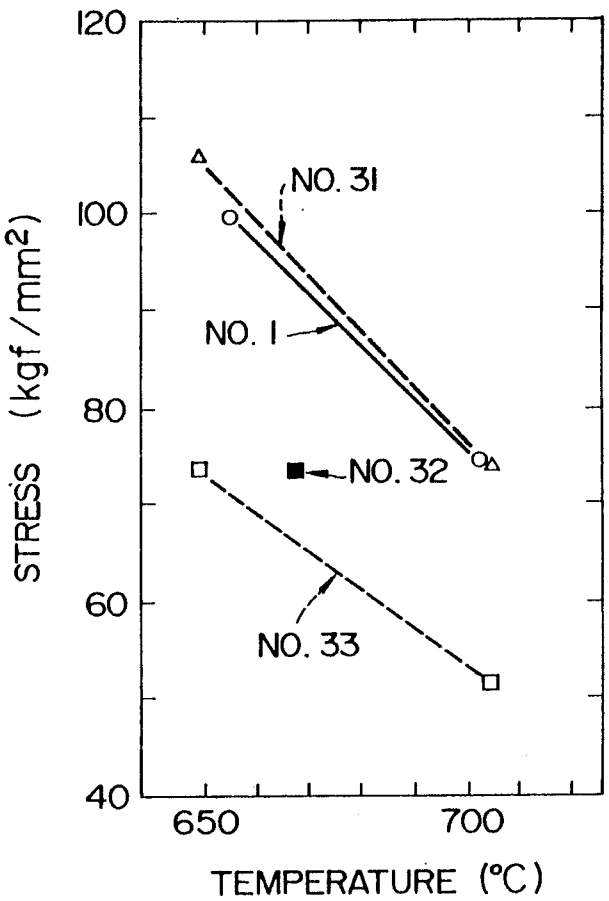
FIG. 2 is a graph showing 100-hours creep rupture strength of alloy of the present invention and those of conventional alloys.

Each of the alloys of compositions shown in Table 1 was melted in a vacuum induction melting furnace and casted into a ingot of 10 kg. The ingot was soaked at 1200° C. for 20 hours and forged into a 30 mm square rod. The forging was conducted in four heats, wherein the first and fourth heats were executed by heating at 1150° C., while the second and third heats were executed by heating in the temperature range between 1050° C. and 1070 ° C. In the fourth heat, the working was executed at a reduction ratio of 25% in the temperature range between 1150° C. and 1030° C. and, further, at a reduction ratio of 15% in the temperature range between 1030° C. and 980° C.

The alloys according to the present invention and the comparison alloys Nos. 21, 22 and 24 exhibited excellent hot workability, but the comparison alloy No. 23 whose $\gamma'$ phase content is 41.8 vol.% was cracked during the forging and the forging was stopped.

In this Example, although forging was adopted as the hot working, it is needless to say that hot rolling may be adopted.

TABLE 1

| Alloy | Chemical composition (wt. %) | | | | | | | | | | | $\gamma'$ phase content | Hot* workability | |
|---|---|---|---|---|---|---|---|---|---|---|---|---|---|---|
| No. | C | Cr | Mo | W | Co | Al | Ti | Nb | Ta | B | Ni | (vol. %) | | Remarks |
| 1 | 0.033 | 18.1 | 4.59 | 4.70 | 10.5 | 1.35 | 2.38 | — | 4.80 | 0.010 | Bal. | 30.2 | ○ | Alloy of invention |
| 2 | 0.033 | 18.5 | 4.65 | 4.50 | 10.4 | 1.73 | 1.92 | — | 4.00 | 0.010 | " | 29.9 | ○ | Alloy of invention |
| 3 | 0.030 | 18.4 | 4.59 | 4.61 | 10.5 | 1.34 | 2.46 | 0.95 | 2.79 | 0.010 | " | 30.0 | ○ | Alloy of invention |
| 4 | 0.029 | 18.2 | 4.65 | 4.50 | 10.5 | 1.34 | 2.36 | — | 4.46 | 0.009 | " | 29.5 | ○ | Alloy of invention |
| 5 | 0.033 | 18.1 | 4.61 | 4.67 | 10.4 | 1.31 | 2.34 | — | 4.77 | 0.010 | " | 29.6 | ○ | Alloy of invention |
| 6 | 0.032 | 18.0 | 4.54 | 4.86 | 10.5 | 1.25 | 2.34 | — | 4.70 | 0.010 | " | 29.6 | ○ | Alloy of invention |
| 7 | 0.033 | 18.1 | 4.62 | 4.69 | 6.3 | 1.33 | 2.41 | — | 4.75 | 0.010 | " | 30.2 | ○ | Alloy of invention |
| 8 | 0.029 | 18.0 | 4.55 | 4.62 | 13.5 | 1.37 | 2.30 | — | 4.55 | 0.011 | " | 30.0 | ○ | Alloy of invention |
| 9 | 0.029 | 18.9 | 3.55 | 3.40 | 11.0 | 1.35 | 2.40 | — | 4.59 | 0.009 | " | 30.1 | ○ | Alloy of invention |
| 10 | 0.033 | 17.8 | 5.45 | 5.59 | 10.3 | 1.30 | 2.35 | — | 4.52 | 0.011 | " | 30.0 | ○ | Alloy of invention |
| 11 | 0.030 | 21.2 | 4.61 | 4.66 | 10.4 | 1.35 | 2.39 | — | 4.68 | 0.010 | " | 30.5 | ○ | Alloy of invention |
| 12 | 0.029 | 19.1 | 4.81 | 4.46 | 11.0 | 1.40 | 2.31 | 0.30 | 4.11 | 0.011 | " | 30.5 | ○ | Alloy of invention |
| 13 | 0.032 | 18.0 | 4.60 | 4.38 | 10.2 | 1.55 | 2.65 | — | 5.13 | 0.009 | " | 34.3 | ○ | Alloy of invention |
| 21 | 0.033 | 18.9 | 4.72 | 4.48 | 10.9 | 1.37 | 3.80 | — | — | 0.010 | " | 30.0 | ○ | Comparison alloy |
| 22 | 0.031 | 18.6 | 4.72 | 4.51 | 10.8 | 1.36 | 2.73 | 2.62 | — | 0.011 | " | 31.7 | ○ | Comparison alloy |
| 23 | 0.035 | 18.0 | 4.30 | 4.35 | 11.0 | 1.75 | 3.20 | — | 7.00 | 0.009 | " | 41.8 | x | Comparison alloy |
| 24 | 0.032 | 17.9 | 4.58 | 4.94 | 10.6 | 1.22 | 2.31 | — | 4.89 | 0.010 | " | 29.5 | ○ | Comparison alloy |

TABLE 1-continued

| Alloy No. | C | Cr | Mo | W | Co | Al | Ti | Nb | Ta | B | Ni | γ' phase content (vol. %) | Hot* workability | Remarks |
|---|---|---|---|---|---|---|---|---|---|---|---|---|---|---|
| | | Chemical composition (wt. %) | | | | | | | | | | | | |
| | | | | | | | | | | | | | | (Zr: 0.05) |

*Note: Marks ○ and x represent, respectively, non-occurrence of cracking and occurrence of cracking during forging.

EXAMPLE 2

Tables 2 and 3 show influence of a heat treatment on tensile properties and creep rupture properties of the alloy No. 2 of the present invention. In the solid-solution heat treatment, the alloy was heated to and held at 1000° C. for 2 hours followed by oil quenching. The aging treatment was conducted in two steps: namely, heating at 650° C. for 24 hours followed by air cooling and heating at 760° C. for 8 hours followed by air cooling. From Table 2, it will be seen that the alloy material subjected to direct aging exhibits, both at room temperature and 650° C., 0.2% offset yield strength and tensile strength which are improved by only about 10% over those of the alloy material subjected to aging after a solid-solution heat treatment, but from Table 3 it will be seen that the alloy material subjected to direct aging exhibits much excellent property in its creep rupture life over that of the alloy material subjected to aging after a solid-solution heat treatment. Further, it will be seen that the alloy material subjected to direct aging exhibits excellent values also in its elongation and reduction of area.

TABLE 2

| Alloy No. | Heat treatment condition | Test temp. (°C.) | Tensile properties: 0.2% offset yield strength (kgf/mm²) | Tensile strength (kgf/mm²) | Elongation (%) | (2) (%) |
|---|---|---|---|---|---|---|
| 2 | Direct aging | Room temp. | 146.8 | 168.1 | 11.2 | 20.5 |
| | | 650 | 128.0 | 154.3 | 14.6 | 18.8 |
| | (1) | Room temp. | 137.0 | 159.9 | 15.7 | 31.6 |
| | | 650 | 118.9 | 146.6 | 17.3 | 17.7 |

(1): Solid-solution heat treatment + aging
(2): Reduction of area

TABLE 3

| Alloy No. | Heat treatment condition | Test condition: Temp. (°C.) | Test condition: Stress (kgf/mm²) | Creep rupture properties: Life (hours) | Elongation (%) | (2) (%) |
|---|---|---|---|---|---|---|
| 2 | Direct aging | 650 | 100 | 93.2 | 20.8 | 20.9 |

TABLE 3-continued

| Alloy No. | Heat treatment condition | Test condition: Temp. (°C.) | Test condition: Stress (kgf/mm²) | Creep rupture properties: Life (hours) | Elongation (%) | (2) (%) |
|---|---|---|---|---|---|---|
| | (1) | " | " | 42.9 | 6.1 | 9.5 |

(1): Solid-solution heat treatment + aging
(2): Reduction of area

EXAMPLE 3

Alloy Nos. 1 to 13, 21, 22 and 24 produced in Example 1 were subjected to direct aging and their tensile properties were tested at room temperature, 650° C., 705° C. and 760° C., and the results thereof are shown in Table 4. Both the alloys of the invention and the comparison alloys exhibit very excellent values in their offset yield strength, tensile strength and elongation at room temperature, 650° C. and 705° C.

In Table 5 there are shown creep rupture properties of the alloy materials subjected to direct aging, under the creep test condition of 650° C. and 100 kgf/mm².

However, with respect to the alloys Nos. 1 and 5 of the present invention, their creep rupture properties under the creep test condition of 705° C. and 75 kgf/mm² are also shown in Table 5. It will be seen that the comparison alloys exhibit the tensile properties equivalent to those of the alloys of the present invention, but they are much inferior in their creep rupture life. The comparison alloy No. 21 exhibits a creep rupture life which is as short as 22.3 hours, because it does not contain Ta and Ni at all. Further, the comparison alloy No. 22 exhibits a creep rupture life of 61.8 hours owing to the effect of Nb, thus providing a remarkable improvement in comparison with the comparison alloy No. 21, nevertheless this improved creep rupture life is still inferior to those exhibited by the alloy of the present invention. A comparison alloy No. 24, which has a composition very similar to that of the alloy No. 1 but contains 0.05% of Zr, caused a notch rupture in a short time of 13.7 hours, and from this fact it will be seen that addition of very small amount of Zr exerts an unfavorable effect on the creep rupture properties in the alloy of the present invention.

TABLE 4

| Alloy No. | 0.2% offset yield strength (kgf/mm²): Room temp. | 650° C. | 705° C. | 760° C. | Tensile strength (kgf/mm²): Room temp. | 650° C. | 705° C. | 760° C. | Elongation (%): Room temp. | 650° C. | 705° C. | 760° C. | Remarks |
|---|---|---|---|---|---|---|---|---|---|---|---|---|---|
| 1 | 142.8 | 123.6 | 117.7 | 97.8 | 161.5 | 151.5 | 137.8 | 117.7 | 16.1 | 12.6 | 20.9 | 23.8 | Alloy of invention |
| 2 | 146.8 | 128.0 | — | 87.2 | 168.1 | 154.3 | — | 110.4 | 11.2 | 14.6 | — | 38.4 | Alloy of invention |
| 3 | 145.2 | 125.8 | — | 93.1 | 163.0 | 153.1 | — | 112.7 | 13.4 | 15.0 | — | 25.1 | Alloy of invention |
| 4 | 152.1 | 128.6 | — | 92.8 | 163.6 | 159.6 | — | 113.9 | 13.6 | 24.0 | — | 28.3 | Alloy of invention |
| 5 | 136.8 | 122.5 | 117.6 | 103.4 | 156.6 | 143.7 | 136.7 | 119.0 | 13.2 | 13.8 | 16.7 | 14.2 | Alloy of invention |
| 6 | 147.6 | 126.0 | 124.7 | — | 168.0 | 157.3 | 142.4 | — | 15.9 | 16.5 | 12.2 | — | Alloy of |

TABLE 4-continued

| Alloy No. | 0.2% offset yield strength (kgf/mm²) Room temp. | 650° C. | 705° C. | 760° C. | Tensile strength (kgf/mm²) Room temp. | 650° C. | 705° C. | 760° C. | Elongation (%) Room temp. | 650° C. | 705° C. | 760° C. | Remarks |
|---|---|---|---|---|---|---|---|---|---|---|---|---|---|
| | | | | | | | | | | | | | invention |
| 7 | 145.2 | 125.1 | — | — | 163.7 | 152.3 | — | — | 14.0 | 15.1 | — | — | Alloy of invention |
| 8 | 143.8 | 127.2 | — | — | 163.3 | 153.5 | — | — | 14.3 | 14.6 | — | — | Alloy of invention |
| 9 | 142.0 | 123.0 | — | — | 158.0 | 150.7 | — | — | 14.6 | 15.6 | — | — | Alloy of invention |
| 10 | 142.0 | 123.0 | — | — | 166.3 | 154.1 | — | — | 12.0 | 13.1 | — | — | Alloy of invention |
| 11 | 145.0 | 125.3 | — | — | 167.0 | 153.5 | — | — | 13.4 | 15.1 | — | — | Alloy of invention |
| 12 | 143.1 | 127.5 | — | — | 165.4 | 153.3 | — | — | 13.4 | 14.2 | — | — | Alloy of invention |
| 13 | 154.0 | 129.9 | — | — | 169.5 | 162.4 | — | — | 9.7 | 10.1 | — | — | Alloy of invention |
| 21 | 146.7 | 125.4 | — | 83.1 | 170.3 | 153.2 | — | 104.7 | 16.5 | 40.7 | — | 49.0 | Comparison alloy |
| 22 | — | 120.5 | — | — | — | 151.5 | — | — | — | 30.3 | — | — | Comparison alloy |
| 24 | 142.0 | 127.1 | 124.4 | — | 168.4 | 160.6 | 141.8 | — | 15.0 | 14.6 | 7.4 | — | Comparison alloy |

TABLE 5

| Alloy No. | Test condition Temp. (°C.) | Stress (kgf/mm²) | Creep rupture properties Life (hours) | Elongation (%) | * (%) | Remarks |
|---|---|---|---|---|---|---|
| 1 | 650 | 100 | 133.8 | 13.9 | 14.9 | Alloy of invention |
| 2 | " | " | 93.2 | 20.8 | 20.9 | Alloy of invention |
| 3 | " | " | 91.8 | 17.1 | 19.4 | Alloy of invention |
| 4 | " | " | 111.1 | 19.2 | 23.6 | Alloy of invention |
| 5 | " | " | 114.5 | 8.3 | 12.8 | Alloy of invention |
| 6 | " | " | 143.5 | 14.5 | 16.1 | Alloy of invention |
| 7 | " | " | 110.5 | 15.2 | 17.9 | Alloy of invention |
| 8 | " | " | 117.3 | 16.3 | 19.1 | Alloy of invention |
| 9 | " | " | 105.5 | 16.1 | 18.8 | Alloy of invention |
| 10 | " | " | 120.3 | 10.7 | 12.1 | Alloy of invention |
| 11 | " | " | 106.5 | 15.8 | 18.0 | Alloy of invention |
| 12 | " | " | 110.2 | 18.9 | 20.0 | Alloy of invention |
| 13 | " | " | 150.9 | 7.0 | 10.1 | Alloy of invention |
| 21 | " | " | 22.3 | 26.9 | 50.9 | Comparison alloy |
| 22 | " | " | 61.8 | 8.3 | 12.8 | Comparison alloy |
| 24 | " | " | 13.7 | Notch rupture | | Comparison alloy |
| 1 | 705 | 75 | 87.9 | 23.9 | 40.0 | Alloy of invention |
| 5 | " | " | 116.1 | 20.0 | 31.5 | Alloy of invention |

*Reduction of area

Next, in comparing mutually the alloys of the present invention, the alloys Nos. 1, 4 and 5 exhibit longer creep rupture life in comparison with the alloys Nos. 2 and 3 by virtue of containing greater amount of Ta. However, the alloy No. 2 containing 4.0% of Ta and the alloy No. 12 in which an amount of Ta corresponding to 13 atomic% of that in No. 1 is substituted with Nb as well as the alloy No. 3 in which an amount of Ta corresponding to 40 atomic% of that in No. 1 is substituted with Nb exhibit shorter creep rupture life than the alloy No. 1, but they exhibit the fully satisfactory properties. The alloys Nos. 7 and 8 exhibit stable properties regardless of the change in the Co content. The alloy No. 10, when compared with the alloy No. 9 having smaller contents of Mo and W, exhibits greater tensile strength and creep rupture life, but its ductility is somewhat smaller than the alloy No. 9. The alloy No. 11 having a greater Cr content than the alloys Nos. 1, 4, 5 and 6 exhibits properties which are quite acceptable. The alloy No. 13 having a comparatively large $\gamma'$ phase content of 34.3 vol.% exhibits excellent hot workability, as well as improved tensile strength and creep rupture life, but is ductility is somewhat inferior to those of other alloys of the present invention.

Figure 1:
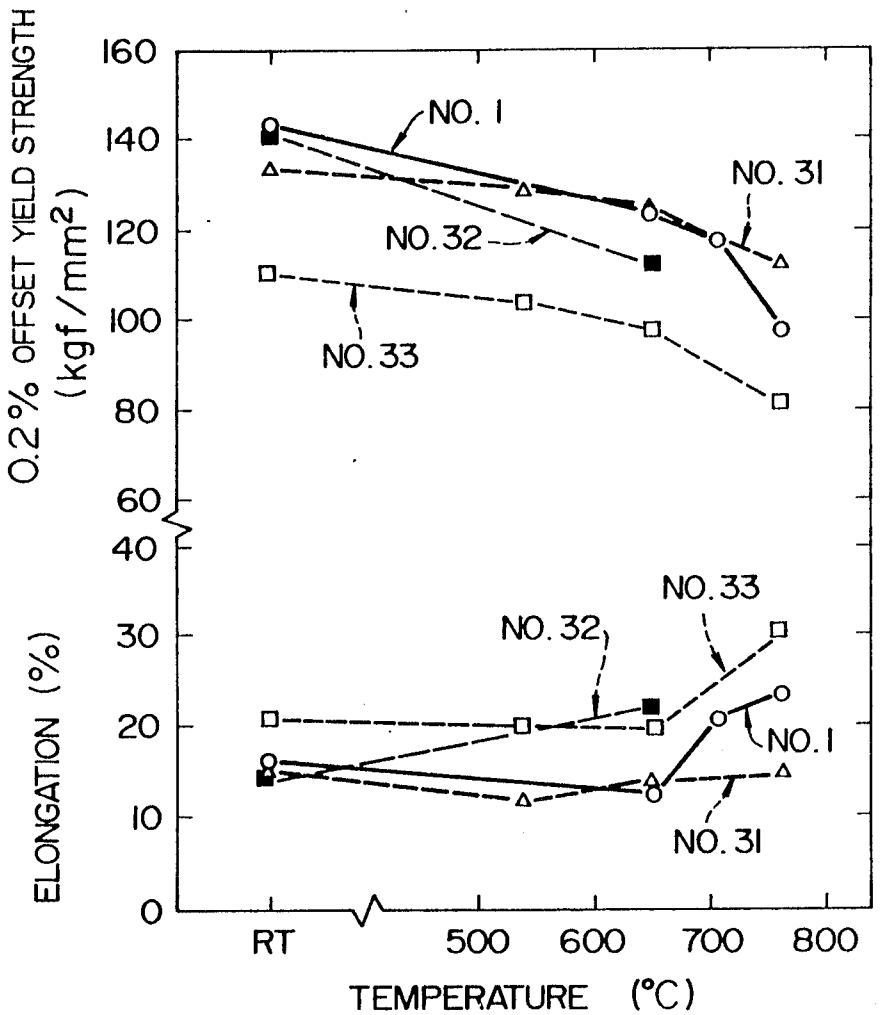
FIG. 1 is a graph showing the tensile properties of alloy of the present invention and those of conventional alloys.

FIG. 1 shows tensile properties (0.2% offset yield strength and elongation) of the alloy No. 1 of the present invention in comparison with those of conventional alloys Nos. 31, 32 and 33, while FIG. 2 shows 100-hour creep rupture strength of the alloy No. 1 of the present invention in comparison with those of the conventional alloys Nos. 31, 32 and 33. The conventional alloy No. 31 is RENE' 95 (0.06C-13Cr-8Co-3.5Mo-3.5W-2.5Ti-3.5Nb-0.05Zr-0.01B-Bal.Ni) which is considered to be the best one presently available by powder metallurgy process. The alloy No. 32 is INCONEL 718 (0.05C-19Cr-3Mo-0 8Ti-0.5Al-5Nb-18Fe-Bal.Ni) subjected to a thermomechanical treatment. The alloy No. 33 is INCONEL 718 subjected to no thermomechanical treatment. The values concerning the alloys Nos. 31 and 33 were extracted from a catalog (3rd edition, July 1977) of International Nickel Company, Inc., while the values concerning the alloy No. 32 were extracted from a literature "F. Turner and H. S. von Harrach: Materials Sci. and Tech., 1986, 2, 733–740". However, with respect to the alloys Nos. 1 and 32, the values shown in FIG. 2 are those obtained by extrapolating the rupture time to 100 hours with the aid of Larson-Miller parameter.

From FIG. 1, it will be seen that the alloy of the present invention exhibits, at temperatures up to 705° C., the 0.2% offset yield strength substantially equivalent to that of the alloy No. 31 and much superior to that of the alloy No. 33 and, in addition, it exhibits, at 650° C., the strength much higher than that of the alloy No. 32. Further, the alloy of the present invention exhibits excellent property with respect also to elongation. Referring now to FIG. 2, the 100-hour creep rupture strength exhibited by the alloy of the present invention at temperatures up to 705° C. is substantially equal to that of the alloy No. 31 which is a powder metallurgy alloy. Thus, the alloy of the present invention is much superior to conventional alloys produced by the ingot making and hot working process also in the aspect of creep rupture strength.

As has been described, according to the alloy of the present invention and the method for producing the same, it becomes possible to attain a strength level demanded by the material for turbine disks or the like, which has hitherto been obtained solely by powder metallurgy process, by using the conventional ingot making and hot working process, so that the present invention greatly contributes to improvement in the reliability of the parts such as gas turbine disks, as well as to reduction in the cost of production of such parts.

What is claimed is:

1. A method of producing an Ni-base superalloy comprising the following successive steps of: preparing an alloy consisting essentially of, by weight, 0.01 to 0.15% of C, 15 to 22% of Cr, 3 to 6% of Mo, 3 to 6% of W, 5 to 15% of Co, 1.0 to 1.9% of Al, 1.5 to 3.0% of Ti, 3.0 to 6.0% of Ta, 0.001 to 0.020% of B and the balance substantially Ni except inevitable impurities; subjecting said alloy to a final hot working in which said alloy is heated to and held at a temperature which is 20° to 100° C. higher than the $\gamma'$ phase's solvus temperature and then hot worked at reduction ratio of 10% or greater during cooling to the recrystallization temperature and subsequently worked at reduction ratio of 10% or greater at temperatures lower than the recrystallization temperature; and directly aged at a temperature lower than 850° C. without subjecting it to solid-solution heat treatment.

2. A method of producing an Ni-base superalloy comprising the following successive steps of: preparing an alloy consisting essentially of, by weight, 0.01 to 0.05% of C, 17 to 19% of Cr, 4 to 5% of Mo, 4 to 5% of W, 8 to 12% of Co, 1.1 to 1.6% of Al, 2.1 to 2.7% of Ti, 4.2 to 5.0% of Ta, 0.005 to 0.015% of B and the balance substantially Ni except inevitable impurities; subjecting said alloy to a final hot working in which said alloy is heated to and held at a temperature which is 20° to 100° C. higher than the $\gamma'$ phase's solvus temperature and then hot worked at reduction ratio of 10% or greater during cooling to the recrystallization temperature and subsequently worked at reduction ratio of 10% or greater at temperatures lower than the recrystallization temperature; and directly aged at a temperature lower than 850° C. without subjecting it to solid-solution heat treatment.

3. A method of producing an Ni-base superalloy comprising the following successive steps of: preparing an alloy consisting essentially of, by weight, 0.01 to 0.15% of C, 15 to 22% of Cr, 3 to 6% of Mo, 3 to 6% of W, 5 to 15% of Co, 1.0 to 1.9% of Al, 1.5 to 3.0% of Ti, Ta and Nb in an amount which meets the conditions of $3.0\% \leqq Ta+2Nb \leqq 6.0\%$ and $Ta \geqq 2Nb$, 0.001 to 0.020% of B and the balance substantially Ni except inevitable impurities; subjecting said alloy to a final hot working in which said alloy is heated to and held at a temperature which is 20° to 100° C. higher than the $\gamma'$ phase's solvus temperature and then hot worked at reduction ratio of 10% or greater during cooling to the recrystallization temperature and subsequently worked at reduction ratio of 10% or greater at temperatures lower than the recrystallization temperature; and directly aged at a temperature lower than 850° C. without subjecting it to solid-solution heat treatment.

4. A method of producing an Ni-base superalloy according to any one of claims 1 to 3, characterized in that in said alloy $\gamma'$ phase having a composition expressed by $Ni_3(Al_xTi_yTa_z)$ $(x+y+z=1)$ or $Ni_3(Al_xTi_yTa_zNb_w)$ $(x+y+z+w=1)$ is contained in an amount not greater than 40 vol.%, that the 0.2% offset yield strength at 650° C. is higher than 120 kgf/mm$^2$, and that the creep rupture time at 650° C. and 100 kgf/mm$^2$ is longer than 80 hours.

* * * * *